US006729467B1

(12) United States Patent
King

(10) Patent No.: US 6,729,467 B1
(45) Date of Patent: May 4, 2004

(54) MULTI-CAVITY CASE

(76) Inventor: Bobby King, 4010 Halifax Rd., Greensboro, NC (US) 27407

( * ) Notice: Subject to any disclaimer, the term of this patent is extended or adjusted under 35 U.S.C. 154(b) by 0 days.

(21) Appl. No.: 10/194,886

(22) Filed: Jul. 12, 2002

(51) Int. Cl.[7] ..... A45C 11/04

(52) U.S. Cl. ..... 206/5; 206/6; 206/747; 206/748

(58) Field of Search ..... 206/5, 6, 575, 206/579, 747, 748; 472/57, 71; 220/523, 525

(56) References Cited

U.S. PATENT DOCUMENTS

| | | | | |
|---|---|---|---|---|
| 2,332,266 | A | | 10/1943 | Segal |
| 3,343,658 | A | | 9/1967 | Renwick |
| 4,023,794 | A | * | 5/1977 | Adams |
| 4,089,412 | A | * | 5/1978 | Baugh |
| 5,701,696 | A | | 12/1997 | Clontz |
| D397,551 | S | | 9/1998 | Shefler |
| 5,921,383 | A | | 7/1999 | Shefler et al. |
| 6,026,950 | A | | 2/2000 | Wisniewski |
| 2003/0178324 | A1 | * | 9/2003 | Watson |

* cited by examiner

*Primary Examiner*—David T. Fidei

(57) ABSTRACT

A multi-cavity ease for holding items such as eyeglasses. The multi-cavity case includes a container that has a first housing member, a second housing member, and a central panel member. Each of the members is movably interconnected by a plurality of elongate connecting members that are alternately coupled to adjacent edges of each of the members of the container such that the container is manipulable between different positions. Each of the housing members has a cavity for holding items. Opposite sides of each of the members of the container are alternately accessible when in the different positions such that each cavity is selectively accessible in one configuration, or partially covered by the connecting members for the purpose of holding items when in a different configuration.

18 Claims, 7 Drawing Sheets

MULTI-CAVITY CASE

BACKGROUND OF THE INVENTION

1. Field of the Invention

The present invention relates to cases and more particularly pertains to a new multi-cavity case for holding items such as eyeglasses.

2. Description of the Prior Art

The use of cases is known in the prior art. U.S. Pat. No. 6,026,950 describes an eyeglass case with glasses-engaging bump. Another type of case is U.S. Pat. No. 5,921,383 which details an eyeglass case with a hinged cover.

While these devices fulfill their respective, particular objectives and requirements, the need remains for a device that is capable of carrying a plurality of items, including eyeglasses and other flat items such as money.

SUMMARY OF THE INVENTION

The present invention meets the needs presented above by the incorporation of a dual housing design with a center panel, all being uniquely coupled to allow access to all sides of each member while selectively accessing or securing the items contained therein.

An object of the present invention is to provide a new multi-cavity case that would not only hold two pairs of glasses, but also could be used to produce an act of prestidigitation due to the nature of the interconnecting design.

To this end, the present invention generally comprises a container that has a first housing member, a second housing member, and a central panel member. Each of the members is movably interconnected by a plurality of elongate connecting members that are alternately coupled to adjacent edges of each of the members of the container such that the container is manipulable between different positions. Each of the housing members has a cavity for holding items. Opposite sides of each of the members of the container are alternately accessible when in the different positions such that each cavity is selectively accessible in one configuration, or partially covered by the connecting members for the purpose of holding items when in a different configuration.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
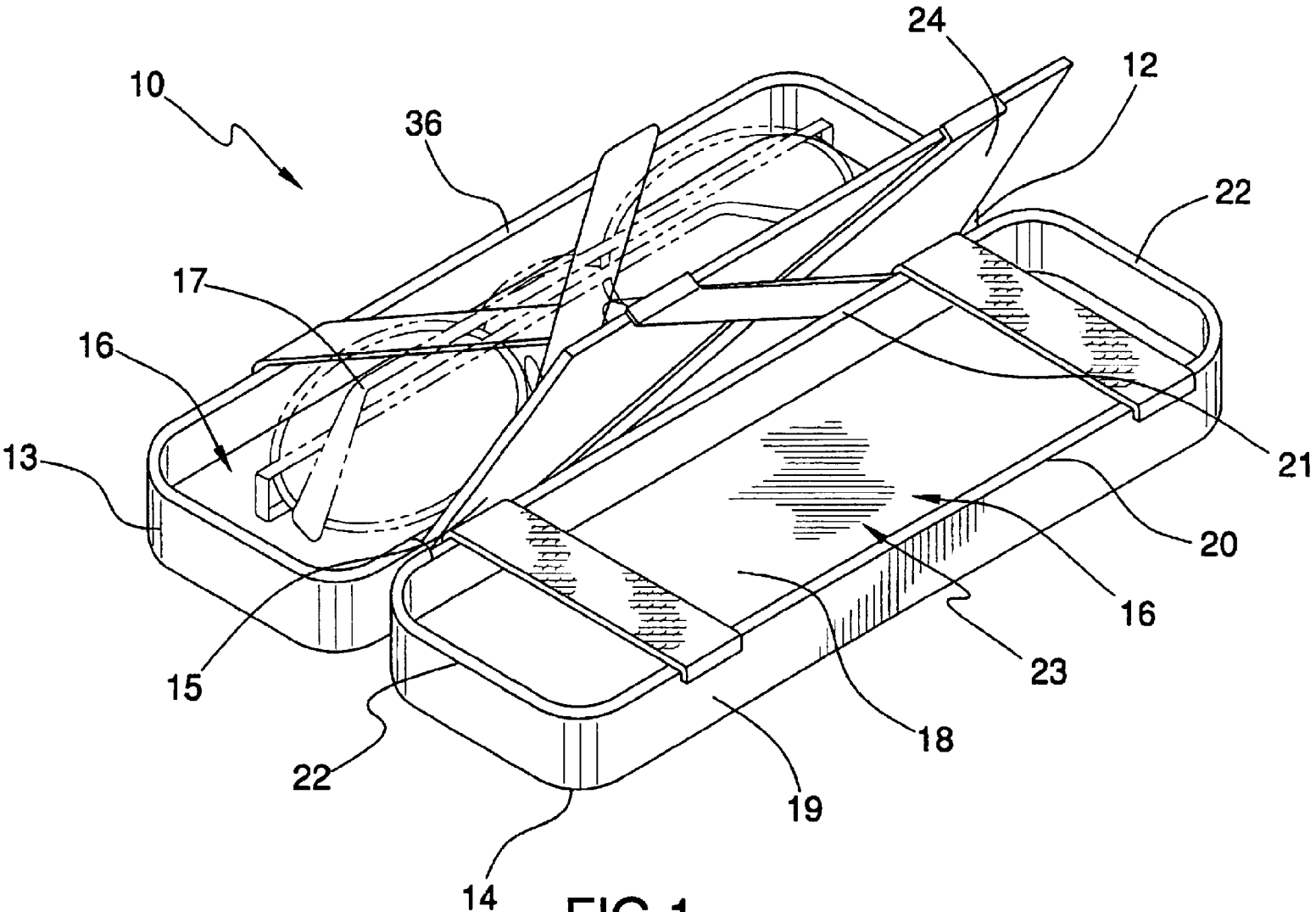
FIG. 1 is a schematic first side perspective view of a new multi-cavity case according to the present invention.
Figure 2:
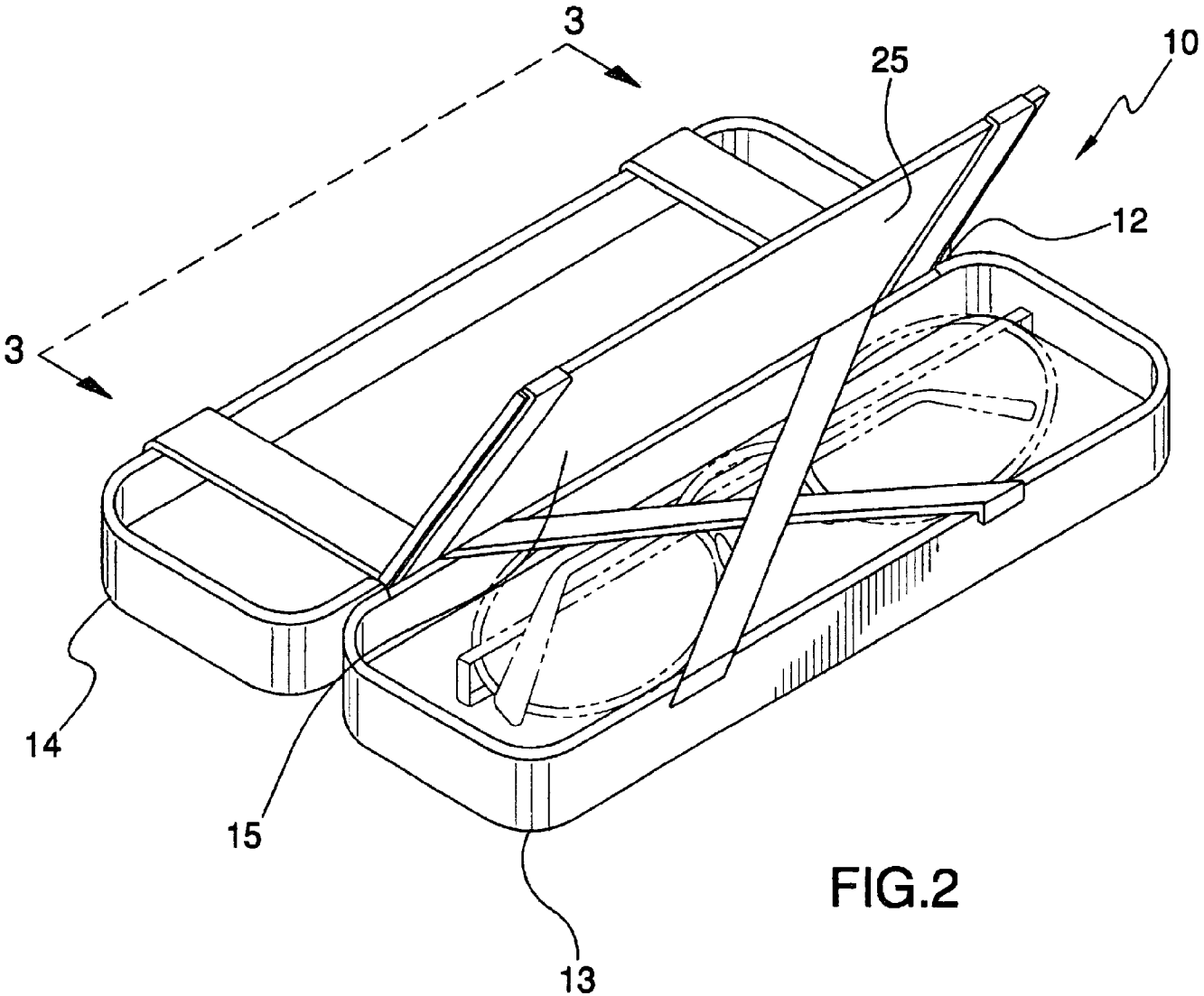
FIG. 2 is a schematic second side perspective view of the present invention.
Figure 3:
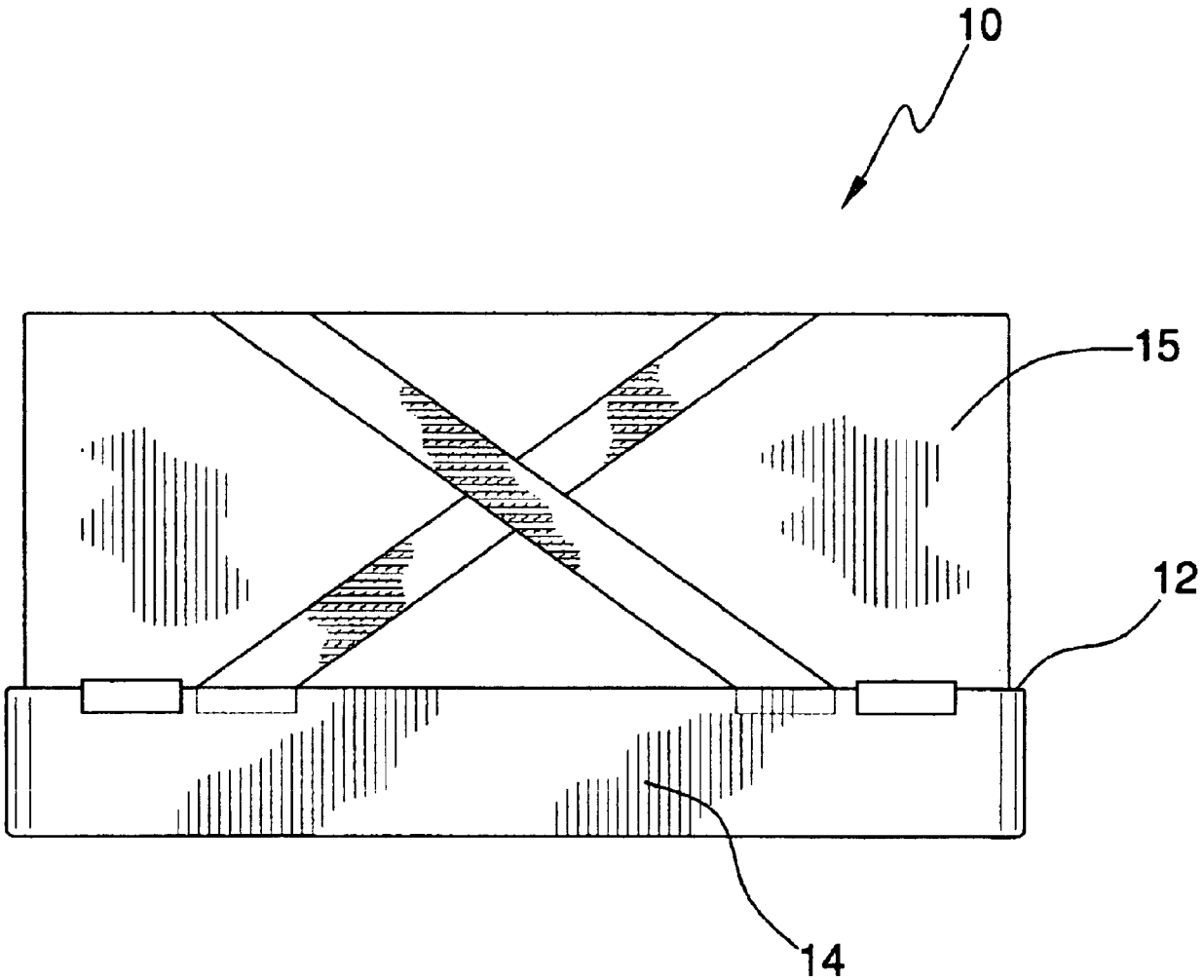
FIG. 3 is a schematic side view of the present invention taken from sectional lines 3—3 in FIG. 2.
Figure 5:
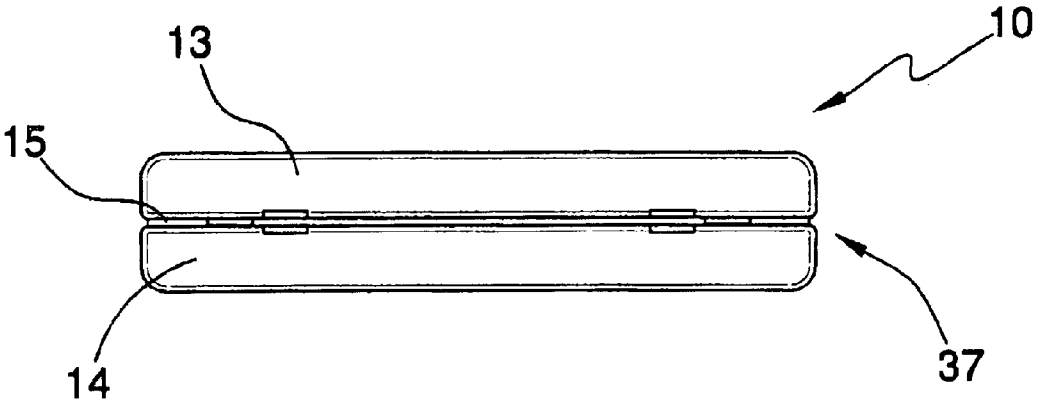
FIG. 5 is a schematic side view of the present invention in the closed position.
Figure 6:
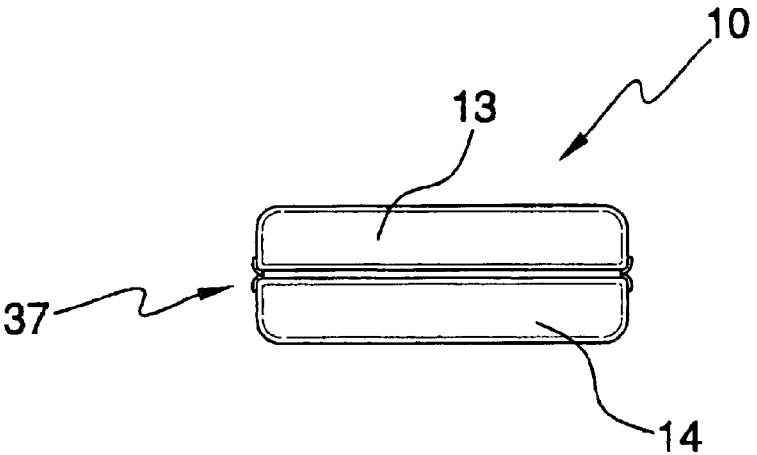
FIG. 6 is a schematic end view of the present invention in the closed position.
Figure 4:
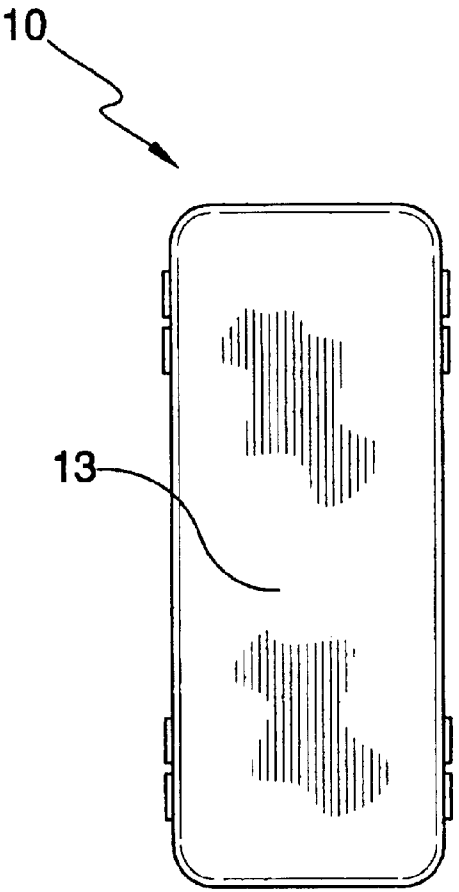
FIG. 4 is a schematic top side view of the present invention in the closed position.
Figure 7:
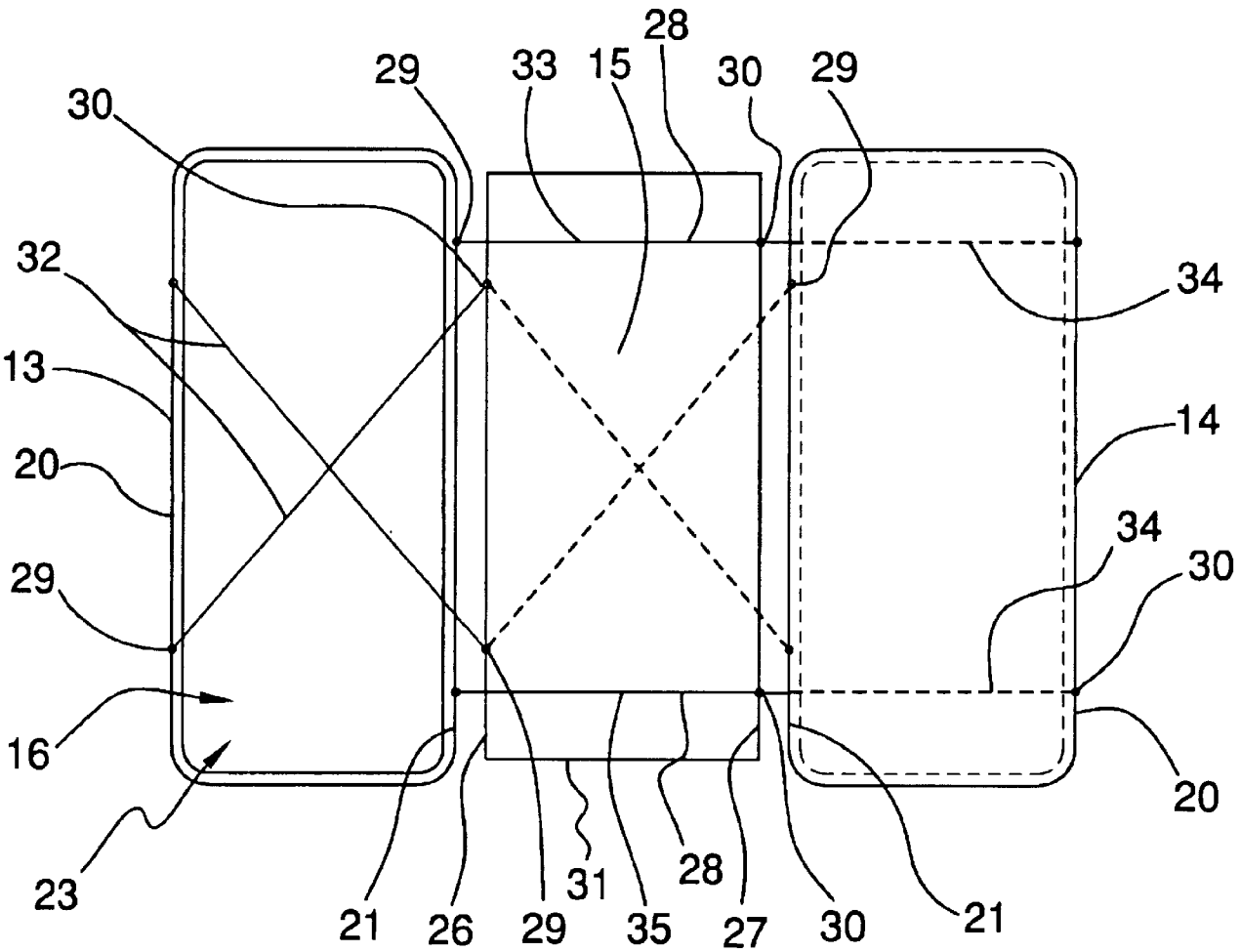
FIG. 7 is a schematic expanded view of the present invention to help depict the connection members.
Figure 9:
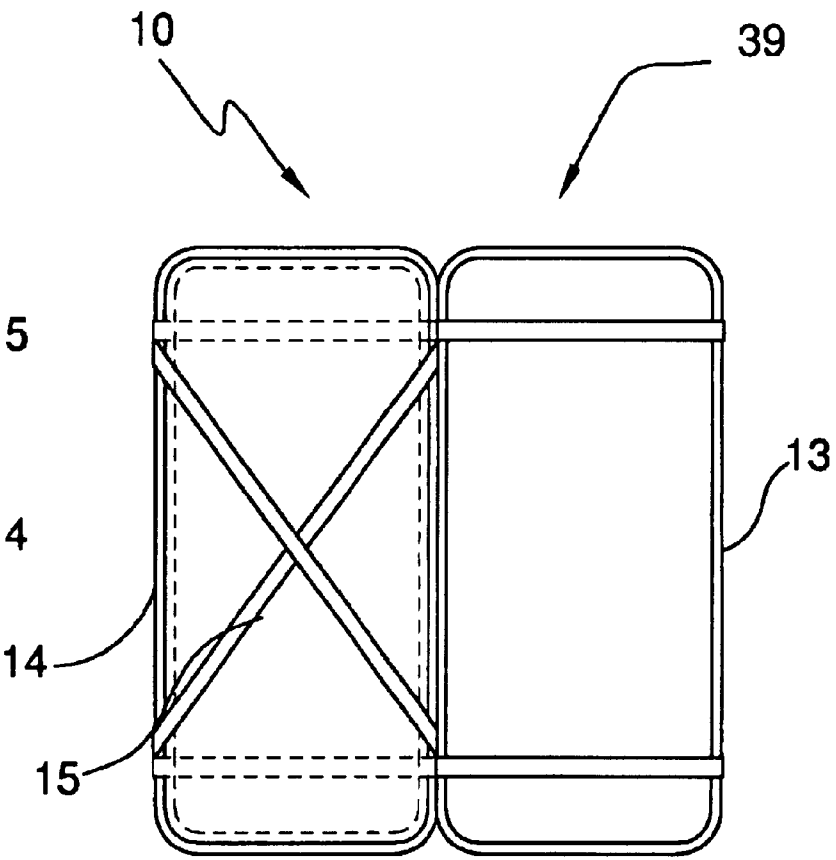
FIG. 9 is a schematic top view of the present invention in the second open position.
Figure 8:
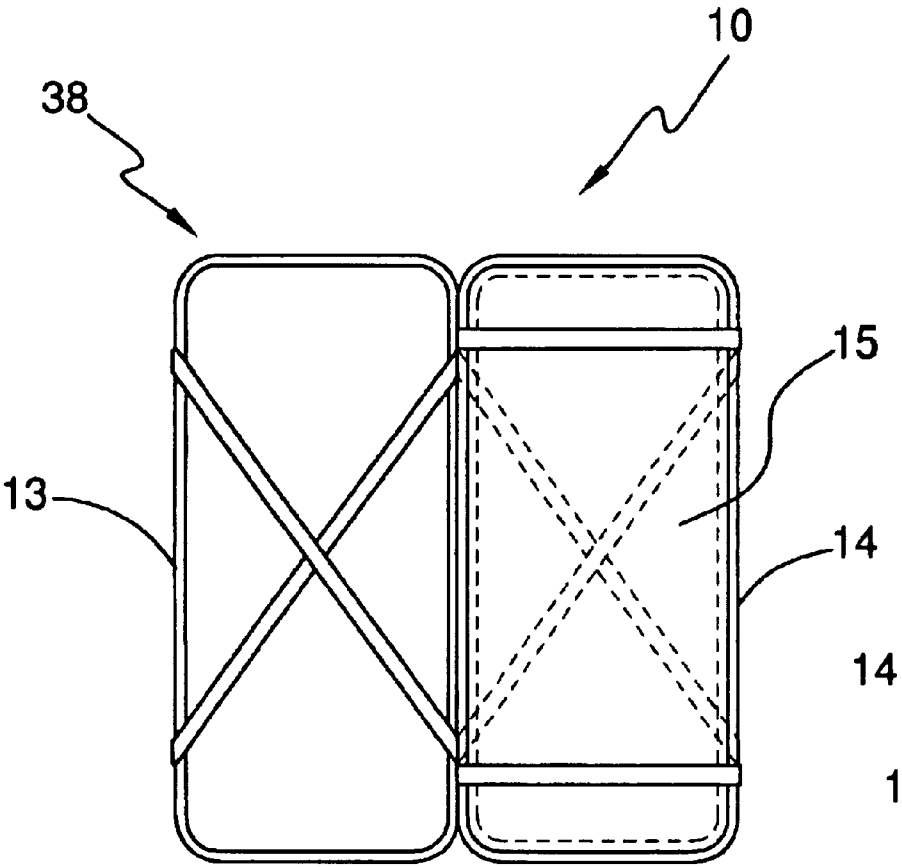
FIG. 8 is a schematic top view of the present invention in the first open position.
Figure 11:
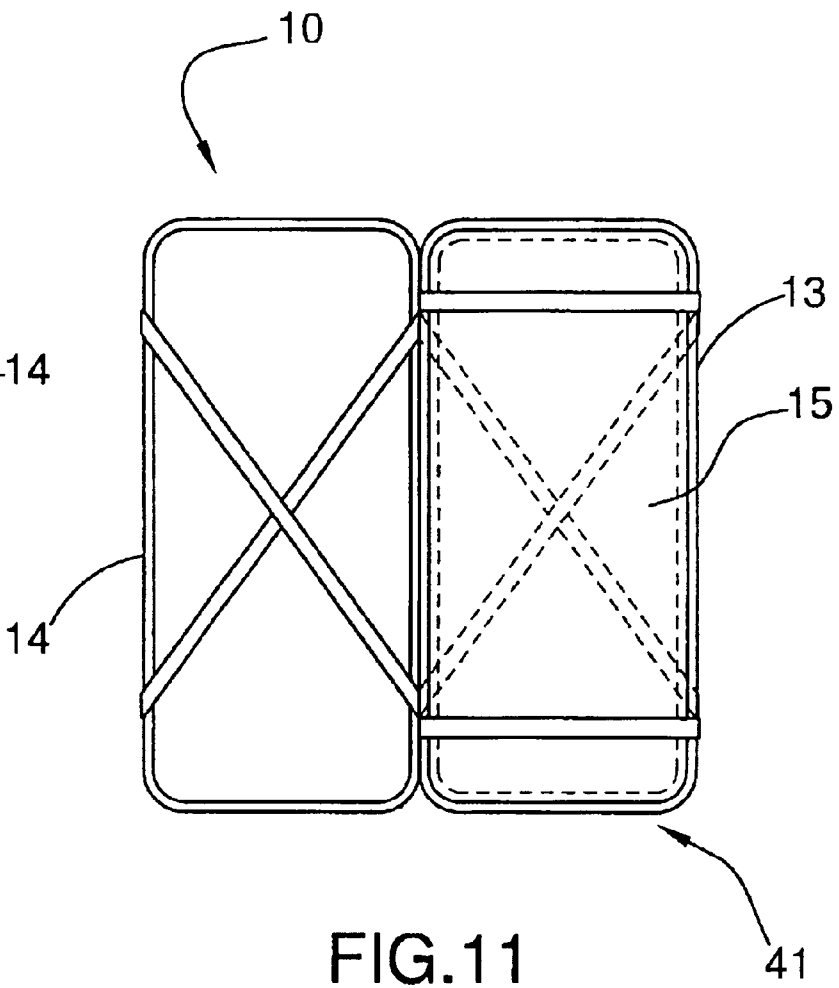
FIG. 11 is a schematic top view of the present invention in the fourth open position.
Figure 10:
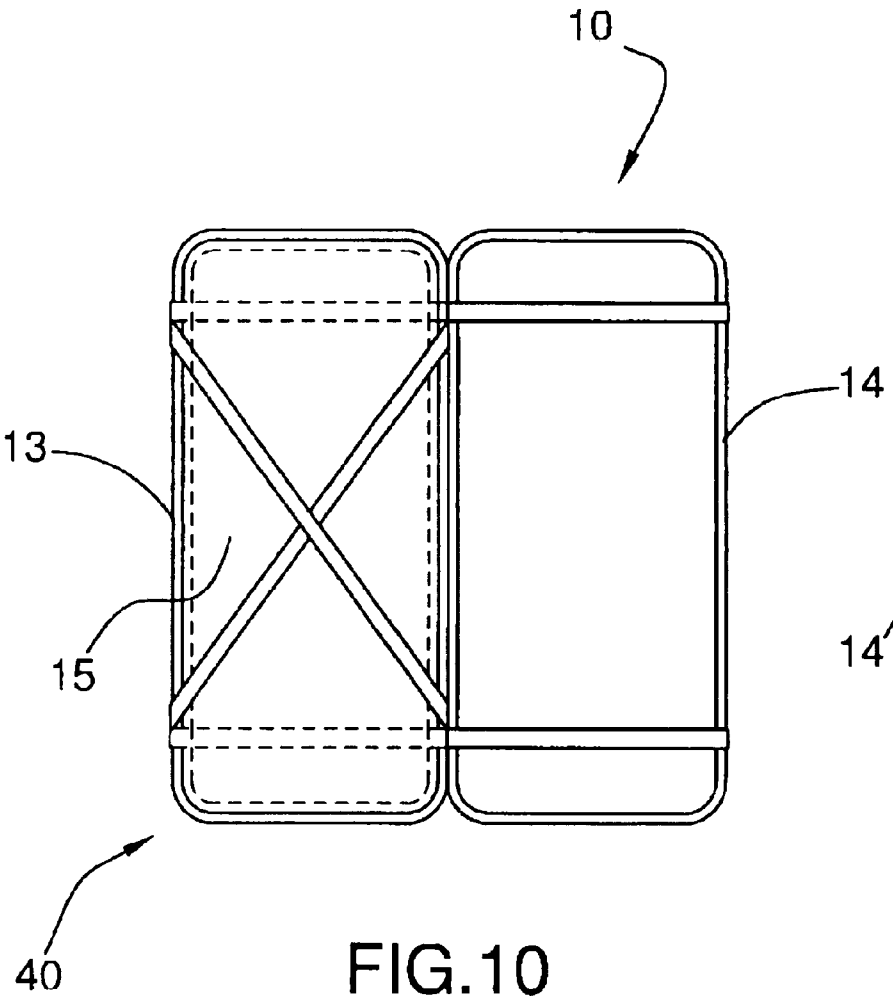
FIG. 10 is a schematic top view of the present invention in the third open position.

With reference now to the drawings, and in particular to FIGS. 1 through 11 thereof, a new multi-cavity case embodying the principles and concepts of the present invention and generally designated by the reference numeral 10 will be described.

As best illustrated in FIGS. 1 through 11, the multi-cavity case 10 generally comprises a container 12 that has a first housing member 13, a second housing member 14, and a central panel member 15. Each of the members is movably interconnected such that the container 12 is manipulable between different positions.

Each of the housing members 13, 14 has a cavity 16 for holding items 17. Each of the housing members 13, 14 has a base wall 18 and a peripheral wall 19 that is attached to and extends away from the base wall 18 to define the cavity 16. The peripheral wall 19 of each of the housing members 13, 14 has an outside edge 20, an inside edge 21, and a pair of end edges 22 defining an opening 23 into the cavity 16.

The panel member 15 has a first side 24, a second side 25, an inner edge 26, and an outer edge 27.

A plurality of elongate connecting members 28 movably interconnects each of the members of the container 12. The plurality of connecting members 28 each has a first end 29 and a second end 30 for attaching to the members of the container 12 and an unattached medial portion 31 extending therebetween. The plurality of connecting members 28 comprises a first pair 32, a second pair 33, a third pair 34, and a fourth pair 35 of connecting members 28.

Opposite sides of each of the members of the container 12 are alternately accessible when in the different positions.

The panel member 15 has dimensions generally equal to an outer perimeter of the peripheral wall 19 of each of the housing members 13, 14. The panel member 15 is positioned between and adjacent to the opening 23 of the cavities 16 such that the panel member 15 serves as a partition between the cavities 16 of the housing members 13, 14 when positioned between top edges 36 of the peripheral walls 19 of each of the housing members 13, 14 and the container 12 is in a closed position 37.

The panel member 15 being positioned between each of the housing members 13, 14 characterizes the closed position 37 and the housing members 13, 14 are diametrically opposed.

First ends 29 of the first pair 32 of the connecting members 28 are attached to the outside edge 20 of the peripheral wall 19 of the first housing member 13. Second ends 30 of the first pair 32 are attached to the inner edge 26 of the panel member 15. Each of the connecting members 28 of the first pair 32 is crossed with respect to each other. Each of the medial portions 31 overly the cavity 16 of the first housing member 13 when the container 12 is in a first open position 38.

First ends 29 of the second pair 33 of the connecting members 28 are attached to the inside edge 21 of the peripheral wall 19 of the first housing member 13. Second ends 30 of the second pair 33 are attached to the outer edge 27 of the panel member 15. Each of the connecting members 28 of the second pair 33 is oriented in a parallel, spaced manner and each of the medial portions 31 overlies the first side 24 of the panel member 15 when the container 12 is in the first open position 38.

The first open position 38 is characterized by the panel member 15 and the second housing member 14 remaining together while the outside edge 20 of the peripheral wall 19 of the first housing member 13 is pivoted away from the outer edge 27 of the panel member 15 until both members 13, 15 are sharing generally the same plane, and the medial portions 31 of the first pair 32 of the connecting members 28 overlies the cavity 16 of the first housing member 13 such that items 17 in the cavity 16 of the first housing member 13 are generally held in place by the first pair 32 of the connecting members 28.

The first housing member 13 and the panel member 15 are manipulable such that the medial portions 31 of each of the connecting members 28 of the first and second pairs 32, 33 can be re-oriented to overlie the opposite member when the container 12 is in a second open position 39.

The second open position 39 is characterized by the panel member 15 and the second housing member 14 remaining together while the inside edge 21 of the peripheral wall 19 of the first housing member 13 is pivoted away from the inner edge 26 of the panel member 15 until both members 13, 15 are sharing generally the same plane, and medial portions 31 of the second pair 33 of the connecting members 28 overlies the cavity 16 of the first housing member 13 such that items 17 in the cavity 16 of the first housing member 13 are generally accessible.

First ends 29 of the third pair 34 of the connecting members 28 are attached to the outer edge 27 of the panel member 15. Second ends 30 of the third pair 34 are attached to the inside edge 21 of the second housing member 14. Each of the connecting members 28 of the third pair 34 is crossed with respect to each other. Each of the medial portions 31 overlies the second side 25 of the panel member 15 when the container 12 is in a third open position 40.

First ends 29 of the fourth pair 35 of the connecting members 28 are attached to the inner edge 26 of the panel member 15. Second ends 30 of the fourth pair 35 are attached to the outside edge 20 of the second housing member 14. Each of the connecting members 28 of the third pair 34 is oriented in a parallel, spaced manner and each of the medial portions 31 overlies the cavity 16 of the second housing member 14 when the container 12 is in the third open position 40.

The third open position 40 is characterized by the panel member 15 and the first housing member 13 remaining together while the outside edge 20 of the peripheral wall 19 of the second housing member 14 is pivoted away from the outer edge 27 of the panel member 15 until both members 14, 15 are sharing generally the same plane, and the medial portions 31 of the fourth pair 35 of the connecting members 28 overlies the cavity 16 of the second housing member 14 such that items 17 in the cavity 16 of the second housing member 14 are generally accessible.

The second housing member 14 and the panel member 15 are manipulable such that the medial portions 31 of each of the connecting members 28 of the third and fourth pairs 34, 35 can be re-oriented to overlie the opposite member when in a fourth open position 41.

The fourth open position 41 is characterized by the panel member 15 and the first housing member 13 remaining together while the inside edge 21 of the peripheral wall 19 of the second housing member 14 is pivoted away from the inner edge 26 of the panel member 15 until both members 14, 15 are sharing generally the same plane, and the medial portions 31 of the third pair 34 of the connecting members 28 overlies the cavity 16 of the second housing member 14 such that items 17 in the cavity 16 of the second housing member 14 are generally held in place by the third pair 34 of the connecting members 28.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A multi-cavity case for holding items, said case comprising:

a container having a first housing member, a second housing member, and a central panel member, each of said housing members having a cavity for holding items, each of said members being movably interconnected such that said container is manipulable between different positions, each of said housing members having a base wall and a peripheral wall attached to and extending away from said base wall to define said cavity, said peripheral wall of each of said housing members having an outside edge, an inside edge, and a pair of end edges defining an opening into said cavity thereof, said panel member having a first side and a second side, said panel member having an inner edge and an outer edge;

a plurality of elongate connecting members for movably interconnecting each of said members of said container, said plurality of connecting members each having a first end and a second end for attaching to said members of said container and an unattached medial portion extending therebetween, said plurality of connecting members comprising a first pair, a second pair, a third pair, and a fourth pair of connecting members; and wherein opposite sides of each of said members of said container are alternately accessible when in said different positions.

2. The multi-cavity case as set forth in claim 1, further comprising said panel member having dimensions generally equal to an outer perimeter of said peripheral wall of each of said housing members, said panel member being positioned between and adjacent to said opening of said cavities such that said panel member serves as a partition between said cavities of said housing members when positioned between top edges of said peripheral walls of each of said housing members and said container is in a closed position.

3. The multi-cavity case as set forth in claim 2, wherein said closed position is characterized by said panel member being positioned between each of said housing members and said housing members being diametrically opposed.

4. The multi-cavity case as set forth in claim 1, further comprising first ends of said first pair of said connecting members being attached to said outside edge of said peripheral wall of said first housing member, second ends of said first pair being attached to said inner edge of said panel member.

5. The multi-cavity case as set forth in claim 1, wherein each of said connecting members of said first pair are crossed with respect to each other, each of said medial portions overlying said cavity of said first housing member when said container is in a first open position.

6. The multi-cavity case as set forth in claim 1, further comprising first ends of said second pair of said connecting members being attached to said inside edge of said peripheral wall of said first housing member, second ends of said second pair being attached to said outer edge of said panel member.

7. The multi-cavity case as set forth in claim 5, wherein each of said connecting members of said second pair are oriented in a parallel, spaced manner and each of said medial portions overlies said first side of said panel member when said container is in said first open position.

8. The multi-cavity case as set forth in claim 5, wherein said first open position is characterized by said panel member and said second housing member remaining together while said outside edge of said peripheral wall of said first housing member is pivoted away from said outer edge of said panel member until both members are sharing generally the same plane, and said medial portions of said first pair of said connecting members overlies said cavity of said first housing member such that items in said cavity of said first housing member are generally held in place by said first pair of said connecting members.

9. The multi-cavity case as set forth in claim 1, wherein said first housing member and said panel member are manipulable such that said medial portions of each of said connecting members of said first and second pairs can be re-oriented to overlie the opposite member when said container is in a second open position.

10. The multi-cavity case as set forth in claim 9, wherein said second open position is characterized by said panel member and said second housing member remaining together while said inside edge of said peripheral wall of said first housing member is pivoted away from said inner edge of said panel member until both members are sharing generally the same plane, and medial portions of said second pair of said connecting members overlies said cavity of said first housing member such that items in said cavity of said first housing member are generally accessible.

11. The multi-cavity case as set forth in claim 1, further comprising first ends of said third pair of said connecting members being attached to said outer edge of said panel member, second ends of said third pair being attached to said inside edge of said second housing member.

12. The multi-cavity case as set forth in claim 1, wherein each of said connecting members of said third pair are crossed with respect to each other, each of said medial portions overlies said second side of said panel member when said container is in a third open position.

13. The multi-cavity case as set forth in claim 1, further comprising first ends of said fourth pair of said connecting members being attached to said inner edge of said panel member, second ends of said fourth pair being attached to said outside edge of said second housing member.

14. The multi-cavity case as set forth in claim 12, wherein each of said connecting members of said third pair are oriented in a parallel, spaced manner and each of said medial portions overlies said cavity of said second housing member when said container is in said third open position.

15. The multi-cavity case as set forth in claim 12, wherein said third open position is characterized by said panel member and said first housing member remaining together while said outside edge of said peripheral wall of said second housing member is pivoted away from said outer edge of said panel member until both members are sharing generally the same plane, and said medial portions of said fourth pair of said connecting members overlies said cavity of said second housing member such that items in said cavity of said second housing member are generally accessible.

16. The multi-cavity case as set forth in claim 1, wherein said second housing member and said panel member are manipulable such that said medial portions of each of said connecting members of said third and fourth pairs can be re-oriented to overlie the opposite member when in a fourth open position.

17. The multi-cavity case as set forth in claim 16, wherein said fourth open position is characterized by said panel member and said first housing member remaining together while said inside edge of said peripheral wall of said second housing member is pivoted away from said inner edge of said panel member until both members are sharing generally the same plane, and said medial portions of said third pair of said connecting members overlies said cavity of said second housing member such that items in said cavity of said second housing member are generally held in place by said third pair of said connecting members.

18. A multi-cavity case for holding items, said case comprising:

a container having a first housing member, a second housing member, and a central panel member, each of said housing members having a cavity for holding items, each of said members being movably interconnected such that said container is manipulable between different positions, each of said housing members having a base wall and a peripheral wall attached to and extending away from said base wall to define said cavity, said peripheral wall of each of said housing members having an outside edge, an inside edge, and a pair of end edges defining an opening into said cavity thereof, said panel member having a first side and a second side, said panel member having an inner edge and an outer edge;

a plurality of elongate connecting members for movably interconnecting each of said members of said container, said plurality of connecting members each having a pair of opposite ends for attaching to said members of said container and an unattached medial portion extending therebetween, said plurality of connecting members comprising a first pair, a second pair, a third pair, and a fourth pair of connecting members;

wherein opposite sides of each of said members of said container are alternately accessible when in said different positions;

said panel member having dimensions generally equal to an outer perimeter of said peripheral wall of each of said housing members, said panel member being positioned between and adjacent to said opening of said cavities such that said panel member serves as a partition between said cavities of said housing members when positioned between top edges of said peripheral walls of each of said housing members and said container is in a closed position;

wherein said closed position is characterized by said panel member being positioned between each of said housing members and said housing members being diametrically opposed;

first ends of said first pair of said connecting members being attached to said outside edge of said peripheral wall of said first housing member, second ends of said first pair being attached to said inner edge of said panel member, wherein each of said connecting members of said first pair are crossed with respect to each other, each of said medial portions overlying said cavity of said first housing member when said container is in a first open position;

first ends of said second pair of said connecting members being attached to said inside edge of said peripheral wall of said first housing member, second ends of said second pair being attached to said outer edge of said panel member, wherein each of said connecting members of said second pair are oriented in a parallel, spaced manner and each of said medial portions overlies said first side of said panel member when said container is in said first open position;

wherein said first open position is characterized by said panel member and said second housing member remaining together while said outside edge of said peripheral wall of said first housing member is pivoted away from said outer edge of said panel member until both members are sharing generally the same plane, and said medial portions of said first pair of said connecting members overlies said cavity of said first housing member such that items in said cavity of said first housing member are generally held in place by said first pair of said connecting members;

wherein said first housing member and said panel member are manipulable such that said medial portions of each of said connecting members of said first and second pairs can be re-oriented to overlie the opposite member when said container is in a second open position;

wherein said second open position is characterized by said panel member and said second housing member remaining together while said inside edge of said peripheral wall of said first housing member is pivoted away from said inner edge of said panel member until both members are sharing generally the same plane, and medial portions of said second pair of said connecting members overlies said cavity of said first housing member such that items in said cavity of said first housing member are generally accessible;

first ends of said third pair of said connecting members being attached to said outer edge of said panel member, second ends of said third pair being attached to said inside edge of said second housing member, wherein each of said connecting members of said third pair are crossed with respect to each other, each of said medial portions overlies said second side of said panel member when said container is in a third open position;

first ends of said fourth pair of said connecting members being attached to said inner edge of said panel member, second ends of said fourth pair being attached to said outside edge of said second housing member, wherein each of said connecting members of said third pair are oriented in a parallel, spaced manner and each of said medial portions overlies said cavity of said second housing member when said container is in said third open position;

wherein said third open position is characterized by said panel member and said first housing member remaining together while said outside edge of said peripheral wall of said second housing member is pivoted away from said outer edge of said panel member until both members are sharing generally the same plane, and said medial portions of said fourth pair of said connecting members overlies said cavity of said second housing member such that items in said cavity of said second housing member are generally accessible;

wherein said second housing member and said panel member are manipulable such that said medial portions of each of said connecting members of said third and fourth pairs can be re-oriented to overlie the opposite member when in a fourth open position; and wherein said fourth open position is characterized by said panel member and said first housing member remaining together while said inside edge of said peripheral wall of said second housing member is pivoted away from said inner edge of said panel member until both members are sharing generally the same plane, and said medial portions of said third pair of said connecting members overlies said cavity of said second housing member such that items in said cavity of said second housing member are generally held in place by said third pair of said connecting members.

* * * * *